US008302359B2

(12) United States Patent
Boxall et al.

(10) Patent No.: US 8,302,359 B2
(45) Date of Patent: Nov. 6, 2012

(54) SYSTEM OF PROTECTING THE EDGES AND CONSTRUCTION JOINTS OF CAST IN PLACE CONCRETE SLABS

(76) Inventors: Russell Boxall, Matthews, NC (US); Nigel A. Parkes, Atlanta, GA (US); Patrick Harrison, Prairie Village, KS (US)

( * ) Notice: Subject to any disclaimer, the term of this patent is extended or adjusted under 35 U.S.C. 154(b) by 1215 days.

(21) Appl. No.: 11/112,431

(22) Filed: Apr. 22, 2005

(65) Prior Publication Data

US 2006/0075706 A1 Apr. 13, 2006

Related U.S. Application Data

(63) Continuation-in-part of application No. 10/885,823, filed on Jul. 7, 2004, now abandoned, which is a continuation of application No. 10/210,464, filed on Jul. 31, 2002, now Pat. No. 6,775,952.

(60) Provisional application No. 60/309,397, filed on Aug. 1, 2001.

(51) Int. Cl.
*E04B 1/682* (2006.01)

(52) U.S. Cl. ..... 52/396.02; 52/402; 52/426; 52/585.1; 404/57; 404/60

(58) Field of Classification Search ..... 52/364, 52/393, 395, 396, 396.02, 396.05, 396.09, 52/426, 435, 585.1, 677, 396.04, 396.07, 52/396.08, 402; 404/47, 52, 56, 57, 58, 59, 404/60, 51, 55, 61–67, 134–136
See application file for complete search history.

(56) References Cited

U.S. PATENT DOCUMENTS

| | | | | |
|---|---|---|---|---|
| 3,372,521 | A * | 3/1968 | Thom | 52/395 |
| 3,527,009 | A * | 9/1970 | Nyquist | 52/396.05 |
| 3,745,726 | A * | 7/1973 | Thom et al. | 52/98 |
| 4,021,984 | A * | 5/1977 | Honegger | 52/471 |
| 4,548,009 | A * | 10/1985 | Dahowski | 52/396.02 |

(Continued)

FOREIGN PATENT DOCUMENTS

DE 3424362 A1 1/1986

(Continued)

OTHER PUBLICATIONS

Guide for Concrete Floor and Slab Construction, Reported by ACI Committee 302, American Concrete Institute, 2 pages (No Date Available).

(Continued)

*Primary Examiner* — William Gilbert
(74) *Attorney, Agent, or Firm* — Banner & Witcoff, Ltd.

(57) ABSTRACT

An improved joint edge assembly, of the type used in the construction of concrete slabs, is disclosed. The assembly comprises a longitudinal joint rail, preferably of steel, which is supported off the ground by formwork. The joint rail comprises first and second joint edge members that are connected to each other by interference-type connectors with self-release elements. A plurality of studs extends downward and outward from each of the joint edge members into the concrete slabs provide a positive mechanical connection between the slab and the joint rail. As the concrete shrinks during hardening, the self-release elements of the interference-type connectors allow the joint to freely open. The joint edge assembly thus provides a self-releasing joint between adjacent slab sections, and protects the edges of the adjacent slab sections from damage. A dowel aligner may also be integrated into the assembly, to allow proper positioning of dowels within the slab.

13 Claims, 3 Drawing Sheets

U.S. PATENT DOCUMENTS

| | | | | |
|---|---|---|---|---|
| 4,804,292 | A * | 2/1989 | DeLuca | 404/69 |
| 6,145,262 | A * | 11/2000 | Schrader et al. | 52/396.02 |
| 2002/0047280 | A1 * | 4/2002 | Burton | 292/340 |

FOREIGN PATENT DOCUMENTS

| | | | |
|---|---|---|---|
| DE | EP0410079 | A1 * | 4/1991 |
| EP | 1389648 | A1 | 2/2004 |
| FR | 2 785 632 | | 11/1998 |

OTHER PUBLICATIONS

ACI Committee 306 Technical Institute, 28 pages (1988).

* cited by examiner

FIG. 1
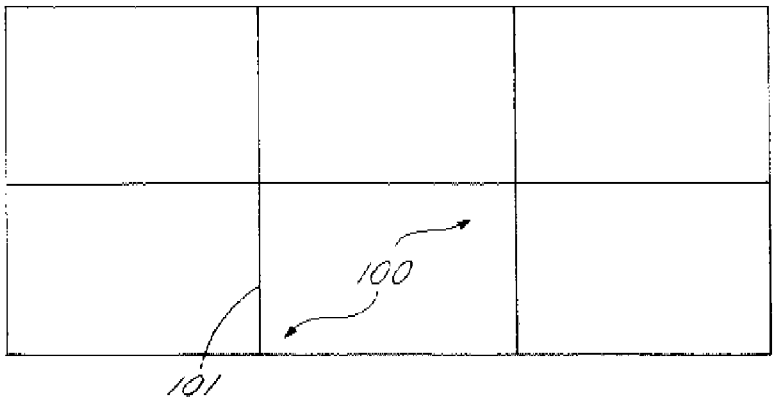
FIG. 3
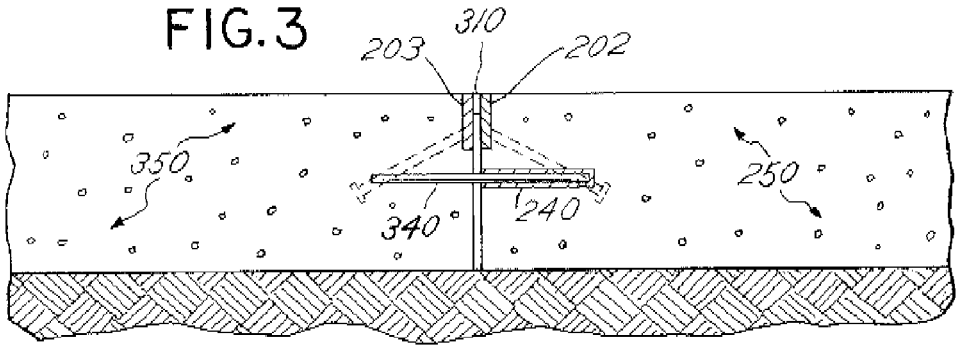
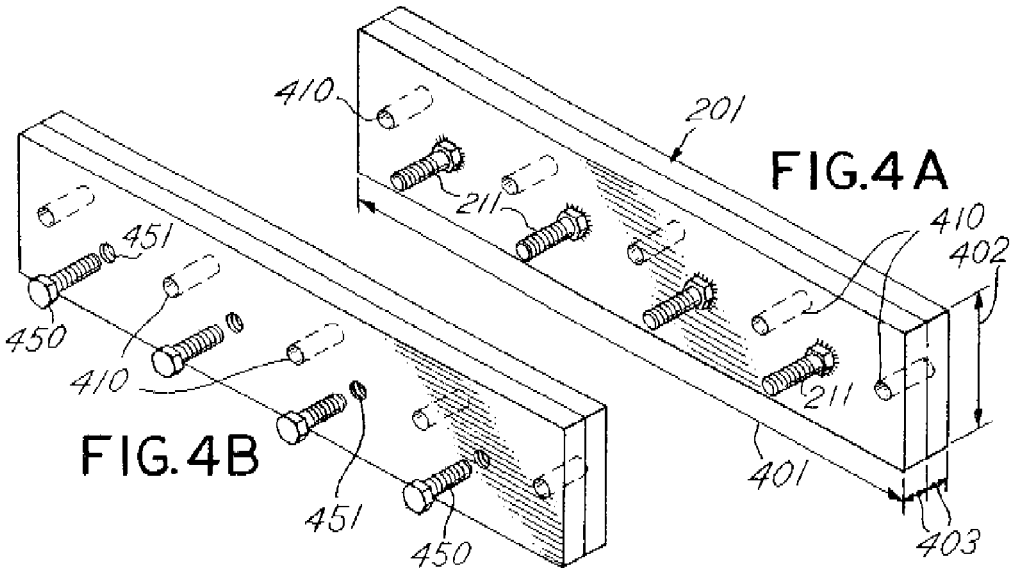
FIG. 4A
FIG. 4B

FIG.5
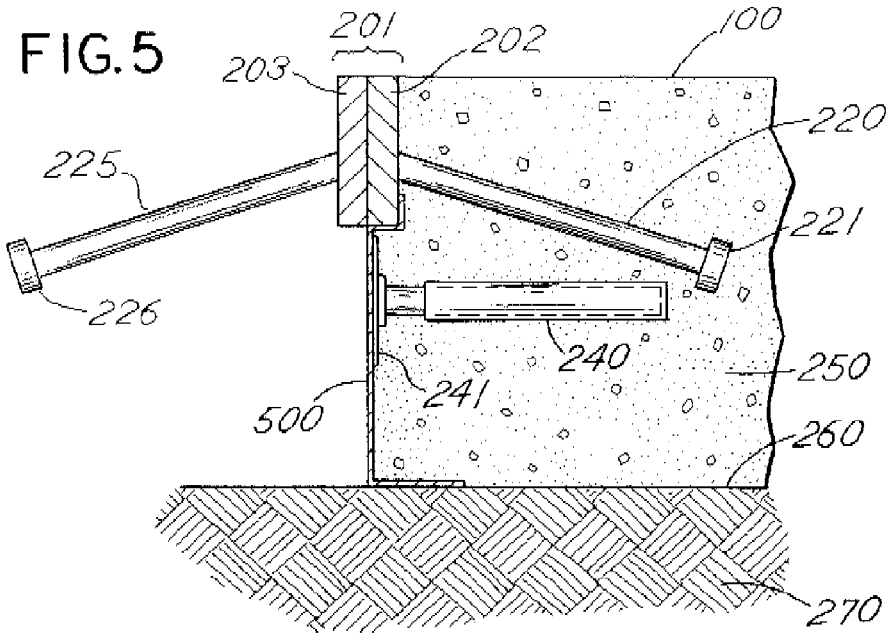
FIG.6
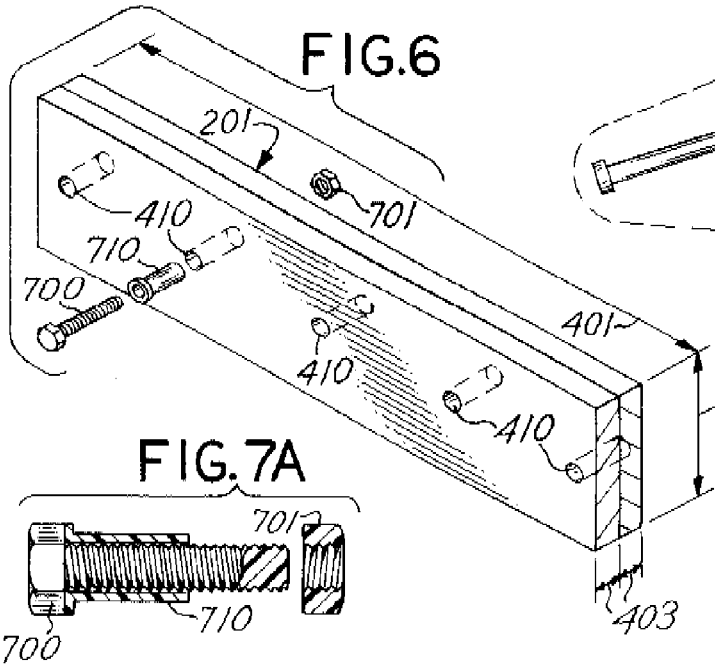
FIG.5A
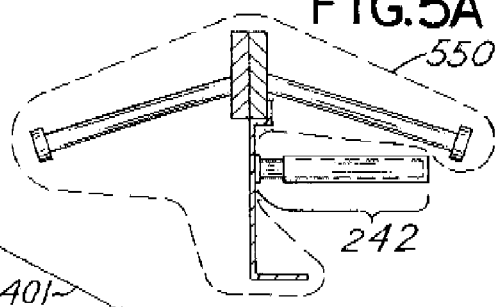
FIG.7A
FIG.7B
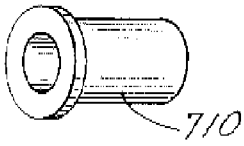
FIG.8
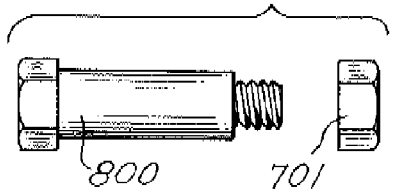

SYSTEM OF PROTECTING THE EDGES AND CONSTRUCTION JOINTS OF CAST IN PLACE CONCRETE SLABS

CROSS REFERENCE TO RELATED APPLICATIONS

This application is a continuation-in-part of, and claims benefit of, U.S. application Ser. No. 10/885,823, filed Jul. 7, 2004, now abandoned, incorporated herein by reference, which is a continuation of, and claims benefit of, U.S. application Ser. No. 10/210,464, filed Jul. 31, 2002, now U.S. Pat. No. 6,775,952, incorporated herein by reference, which is based on, and claims the benefit of, U.S. Provisional Application Ser. No. 60/309,397, filed on Aug. 1, 2001, entitled "System of Protecting the Edges of Cast in Place Concrete Slab on Ground, Construction Joints.

BACKGROUND OF THE INVENTION

1. Field of the Invention

This invention relates generally to the construction of concrete slabs. More particularly, the invention relates to an improved joint edge assembly that protects the joint edges, permits more accurate alignment of the joint edge assembly members, and allows the joint edges to both self-open and move laterally with respect to the opposite joint edge as the concrete shrinks during hardening.

2. Related Art

For logistical and technical reasons, concrete floor slabs are made up of a series of individual blocks. The interface where one block meets another is termed a joint. Freshly placed concrete shrinks considerably as it hardens as the chemical reaction between the cement and the water occurs, i.e., hydration. As the concrete shrinks, tensile stress accumulates in the concrete. Therefore, the joints should be free to open and thus allow shrinkage to occur without damaging the slab.

The joint openings, however, create discontinuities in the slab surface, which can cause the wheels of forklift trucks and other vehicles to impact the joint edges and chip small pieces of concrete from the edge of each slab, particularly if the joint edges are not aligned. This damage to the edges of slabs is commonly referred to as "joint spalling." Joint spalling often interrupts the normal working operations of many facilities by slowing down forklift and other truck traffic, and/or causing damage to trucks and the carried products. Severe joint spalling and uneven joints can even cause loaded forklift trucks to be overturned and can be dangerous to employees. Moreover, joint spalling can be very expensive to repair.

For these reasons, it is advantageous to protect the joint edges against spalling with steel bars or angles. Commonly used details illustrating the use of hot rolled steel bars (or angles) are shown in the American Concrete Industry (ACI) technical manuals 302 and 360. However, the standard installation procedure for these steel bars or angles is both time-consuming and expensive. The conventional procedures typically includes the following steps: (1) a temporary edge form is erected; (2) the first bar (or angle) is attached to the edge form; (3) the first concrete slab is cast; (4) the form is removed; (5) the second bar (or angle) is tack welded to the first; (6) the second concrete slab is cast; and (7) the tack welds are removed by grinding. Importantly, the quality control of the tack welding and the timing of the tack weld grinding are critical to the joint performance. If a weld is not completely removed by grinding, or if grinding is not completed shortly after the second slab is cast, then the joint remains locked together and tensile stress accumulates in the slabs, which often leads to unacceptable slab cracking. Furthermore, if the joint edge members are not evenly aligned during the tack welding, a permanent slab discontinuity may result in the finished product, which may also lead to increased impact with the joint edges.

For at least the foregoing reasons, an improved joint edge assembly that protects the joint edges of the concrete slab, permits more accurate alignment of the joint edge assembly members, and allows the joint edges to both self-open and move laterally with respect to the opposite joint edge as the concrete shrinks during hardening would be desirable.

SUMMARY OF THE INVENTION

The invention is an improved joint edge assembly that protects the joint edges of concrete slabs, permits more accurate alignment of the joint edge assembly members, and allows the joint edges to both self-open and move laterally with respect to the opposite joint edge as the concrete shrinks during hardening. The apparatus comprises a longitudinal joint rail, made up of two elongated joint edge members. The elongated joint edge members are typically steel bar sections, but can be any similar suitable material. The sections are connected to one another along their length by a set of interference-type connectors. The connectors remain throughout the concrete pouring operation and include release elements that allow the joint edge members to release from each other under the force of the slabs shrinking during hardening, thus allowing the joint to open as well as move laterally with respect to the opposite joint edge. Moveover, the interference-type connectors ensure the flush, i.e., level, alignment of the elongated joint edge members. The joint rail may be either supported above the ground surface by permanent formwork seated on the ground surface, or by a mounting bracket attached to temporary formwork seated on the ground surface. A plurality of studs extends from the elongated joint edge members into the region where the slab is to be poured such that, upon hardening of the concrete slab, the studs are integrally cast within the body of the slab. One or more dowel aligners may be integrated into the form assembly to allow dowels to be accurately positioned within the adjacent slab sections. Alternatively, a base and sleeve may be used where a load plate is employed between adjacent slabs rather than dowels.

When the first of the adjacent slab sections is poured, the claimed form assembly restrains the wet concrete. Preferably, studs extending from the longitudinal joint rail become embedded in the concrete slab, providing a positive mechanical connection between the slab and the form assembly when the concrete hardens. Before pouring the adjacent slab, the dowels or load plates are placed, if desired, using the aligners that were cast into the first concrete slab. After pouring the adjacent slab, the studs extending from the longitudinal joint rail into the adjacent slab region become embedded in the adjacent concrete slab, providing a positive mechanical connection between the adjacent slab and the form assembly. As the chemical reaction between the cement and the water occurs, i.e., hydration, the concrete hardens and shrinks. As the slabs shrink away from one another, the self-release elements allow the elongated joint edge members to separate from one another as well as move laterally with respect to the opposite joint edge. If desired, the gap formed by the separated joint edge members may be filled with a sealant.

BRIEF DESCRIPTION OF THE DRAWINGS

FIG. 1 is a plan view of concrete slab with joints at the interface of the individual blocks.

FIG. 3 is a cross section of the completed joint edge constructed in accordance with the present invention using temporary formwork showing the placement of the dowels between concrete slabs.

FIG. 4A is a perspective view of the joint rail in the present invention showing bolts affixed to the joint rail for attaching temporary formwork mounting brackets.

FIG. 4B is a perspective view of the joint rail in the present invention showing threaded holes in the joint rail for receiving bolts to attach temporary formwork mounting brackets.

FIG. 5 is a cross section view of the joint edge assembly constructed in accordance with the present invention using permanent formwork.

FIG. 5A is a detail of FIG. 5 showing the factory assembled form assembly and the dowel aligner for use with permanent formwork.

FIG. 6 is a perspective view of the joint rail in the present invention for use with permanent formwork.

FIG. 7A is a cross section of the interference-type ferrule with the nut and bolt assembly used in accordance with the present invention.

FIG. 7B is a perspective view of the interference-type ferrule in accordance with the present invention.

FIG. 8 is an interference-type shoulder bolt and nut assembly in accordance with the present invention.

DETAILED DESCRIPTION OF CERTAIN PREFERRED EMBODIMENTS

Figure 2:
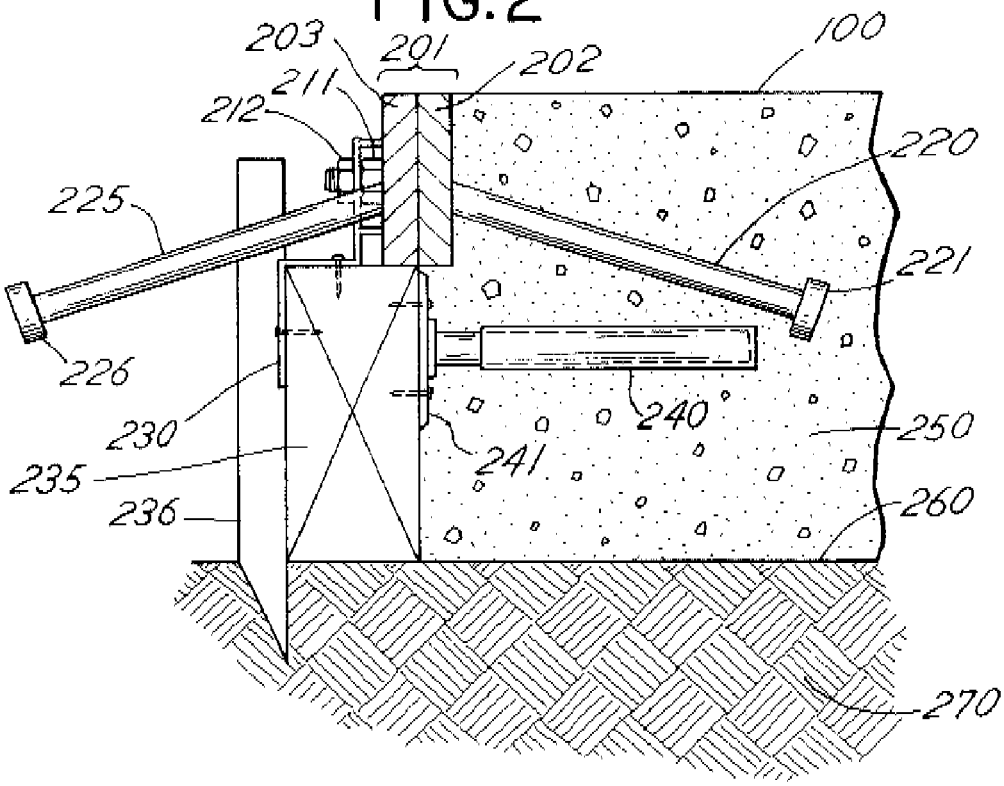
FIG. 2 is a cross section view of the joint edge assembly constructed in accordance with the present invention using temporary formwork.
Figure 2A:
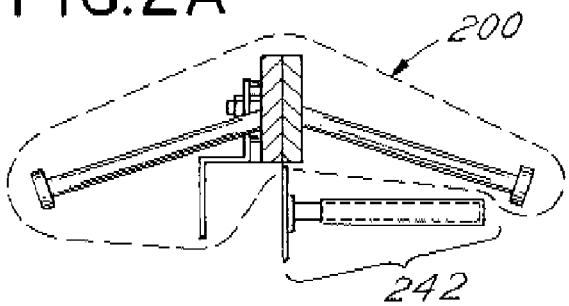
FIG. 2A is a detail of FIG. 2 showing the factory assembled form assembly and the dowel aligner for use with temporary formwork.

Preferred designs for a form assembly made in accordance with the claimed invention are shown in the drawings. In FIG. 2A, the preferred embodiment of the form assembly 200 for use with temporary formwork is shown. Referring to FIG. 2, the form assembly 200 includes a longitudinal joint rail 201, which is comprised of two joint edge members 202, 203. The joint edge members 202, 203 are typically steel bar sections, but any other suitable steel section, such as an angle section, can be used. FIGS. 4A, 4B show the three, dimensional components of the joint rail 201, the longitudinal dimension 401, the major latitudinal dimension 402, and the minor latitudinal dimension 403. In situ, the longitudinal dimension 401 is oriented along the length of the joint 101 between adjacent concrete slab sections 100 (shown in FIG. 1) and parallel to the ground surface 260, which defines a generally flat reference plane. The major latitudinal dimension 402, when in situ, extends generally perpendicular to the reference plane 260 and the minor latitudinal dimension 403, when in situ, extends generally parallel to the reference plane 260. The steel rails, i.e., joint edge members 202, 203, are oriented, when in situ, with the major latitudinal dimensions 402 thereof adjacent to each other.

In a preferred embodiment for use with temporary formwork, holes 410 (shown in FIGS. 4A, 4B) are drilled through the joint rail 201 at longitudinal intervals, so that an interference-type connector, for example, a ferrule insert, 710 and associated bolt 700 can be passed through the joint rail 201 and secured with a nut 701. "Interference-type" is intended to mean an insert that is slightly larger than the holes 410 such that the fit of the insert is substantially tight, thereby substantially eliminating any "play" in the insert or the two joint edge members. The ferrule insert 710 shown is a tubular configuration with a flange at the insertion end. The invention is not limited, however, to tubular shapes; other configurations such as square and triangular are suitable as well, as long as the insert is of an "interference-type" and has a center shaft or other means to secure the joint edge members 202, 203, such as the placement of a bolt 700 and nut 701. Further, a flange on the insert is not required. The interference-type ferrule insert 710 assists in maintaining the alignment of the joint edge members 202, 203 by substantially eliminating relative movement of the joint edge members 202, 203 during construction handling and set-up. As shown in FIG. 4A, a bolt 700 passes through the ferrule 710 inserted in the hole 410 of the joint rail 201 in a direction generally parallel to the minor latitudinal dimension 403 and is secured with a nut 701. An alternative to the ferrule 710 and bolt 700 configuration is an interference-type shoulder bolt 820 (FIG. 8). Those with skill in the art having the benefit of this disclosure would be able to determine other feasible configurations.

The mounting bracket 230 for the temporary formwork shown in FIG. 2 is secured to the joint rail 201 by the connectors 450 shown in FIG. 4B inserted into threaded holes 451. The threaded holes 451 typically do not extend into the second joint edge member 202 so that the connectors 450 will not secure the second joint edge member 202 to the first joint edge member 203. Note, however, that this is merely precautionary, since the connectors 450 should be removed with the temporary formwork. Alternatively, bolts 211 may be attached, for example by welding, to the joint rail and the mounting bracket 230 secured by a nut 212 as shown in FIG. 4A and FIG. 2. Those with skill in the art having the benefit of this disclosure would be able to determine other feasible configurations for securing the mounting bracket 230. The mounting bracket 230 is of any suitable configuration to secure the joint rail 201 to the temporary formwork 235. The temporary formwork 235 is typically comprised of standard 2" lumber sections selected according to the design thickness of the concrete slabs 250, 350. The mounting bracket 230 is designed such that the form assembly 200 can be temporarily affixed to the temporary formwork 235, so that the edge of the temporary formwork 235 aligns with the interface of the first and second joint edge members 202, 203. The connectors 211, 212, or 450 are typically comprised of steel, and secure the mounting bracket until the temporary formwork 235 is removed in preparation for pouring the adjacent concrete slab 350.

Also shown in FIG. 2 are anchors 220, 225 that are permanently affixed to the joint edge members 202, 203, typically by welding, in order to provide a positive mechanical connection between the concrete slabs 250, 350 and the joint edge members 202, 203. The anchors 220, 225 are typically comprised of headed steel studs. The studs 221, 226 extend downward and outward from the joint rail 201 such that when the concrete slabs 250, 350 are poured, the studs 221, 226 are embedded within the concrete slab. Although a headed stud is preferred, a non-headed stud may be used. Alternatively, the anchor may have ridges or a rough surface to help concrete adhere to the anchor during hardening. As used herein, the term anchor or stud generally includes any structure that projects from the rail assembly to become embedded in the slab, positively connecting the slab to the form assembly.

Ideally, the form assembly 200 shown in FIG. 2A is factory assembled to exacting tolerances. This insertion of the interference-type connectors improves alignment of the joint edge members 202, 203, i.e., the levelness across the joints 101, and makes the finishing of the adjacent concrete slabs easier.

To use the assembly, the factory assembled form assembly 200 is secured to the temporary formwork 235 in the field by any suitable means. The temporary formwork is aligned and fixed in position with stakes 236 or any other suitable member. As in any concrete slab construction, the alignment of the formwork is necessary to insure the desired finished product. One or more dowel aligners 242 (see FIG. 2A) may be integrated into the form assembly to permit dowels 340 (see FIG. 3) to be accurately positioned within the adjacent concrete slab sections. Each dowel aligner 242 comprises a dowel sleeve 240 and a dowel support member 241 attached to the temporary formwork 235. The dowel sleeve permits a dowel 340 to be installed parallel to the minor latitudinal dimension 403 after the first concrete slab 250 has begun to harden and the temporary formwork 235 is removed. Alternatively, a base and sleeve may be used where a load plate is employed between adjacent slabs rather than dowels. As used herein, the dowels generally include any structure that projects from one concrete slab to an adjacent concrete slab, positively connecting the two slabs.

Once the form assembly 200 is properly secured and aligned, the first concrete slab 250 is poured. The studs 220 extending from the first joint edge member 202 become embedded in the wet concrete, and provide a positive mechanical connection between the concrete slab 250 and the joint edge member 202 when the concrete hardens. Once the concrete slab 250 has hardened sufficiently, the connectors 212 or 450 are removed followed by the stakes 236, the mounting brackets 230, the temporary formwork 235, and the dowel support members 241. After positioning the dowels 340 in the dowel sleeves 240, the adjacent concrete slab 350 is poured and finished such that the studs 226 extending from the second joint edge member 203 become embedded in the wet concrete of the adjacent concrete slab 350.

In FIG. 5A, the preferred embodiment of the form assembly 550 for use as permanent formwork is shown. Referring to FIG. 5, the form assembly 550 includes a longitudinal joint rail 201, which is comprised of two joint edge members 202, 203. Also in FIG. 5 is shown the permanent formwork member 500. The permanent formwork typically comprises a thin metal plate material that is secured to the joint rail 201 by any suitable means such as tack or plug welding. The permanent formwork remains in place during the pour of the second concrete slab.

In a preferred embodiment for use with the permanent formwork, holes 410 (shown in FIG. 6) are drilled through the joint rail 201 at longitudinal intervals, so that an interference-type connector, for example, a ferrule insert, 710 and associated bolt 700 can be passed through the joint rail 201 and secured with a nut 701. The interference-type ferrule insert 710 assists in maintaining the alignment of the joint edge members 202, 203 by substantially eliminating relative movement of the joint edge members 202, 203 during construction handling and set-up. An alternative to the ferrule 710 and bolt 700 configuration is an interference-type shoulder bolt 820.

One or more dowel aligners 242 (see FIG. 5A) may be integrated into the form assembly to permit dowels 340 (see FIG. 3) to be accurately positioned within the adjacent concrete slab sections. Each dowel aligner 242 comprises a dowel sleeve 240 and a dowel support member 241 attached to the temporary formwork 235. The dowel sleeve permits a dowel 340 to be installed parallel to the minor latitudinal dimension 403 after the first concrete slab 250 has begun to harden and the temporary formwork 235 is removed. Alternatively, a base and sleeve may be used where a load plate is employed between adjacent slabs rather than dowels.

Ideally, the form assembly 550 shown in FIG. 5A is factory assembled to exacting tolerances. This insertion of the interference-type connectors improves alignment of the joint edge members 202, 203, i.e., the levelness across joints 101, and makes the finishing of the adjacent concrete slabs easier.

As the chemical reaction between the cement and the water in the adjacent concrete slab 350 occurs, i.e., hydration, the concrete hardens and shrinks. This chemical reaction is ongoing in the first concrete slab 250 also, as the process continues for an extended period of time. As the slabs 250, 350 shrink away from one another, the self-release elements in the interference-type connectors allow the elongated joint edge members 202, 203 to separate from one another as well as move laterally with respect to each other. If desired, the gap formed by the separated joint edge members 202, 203 can be filled with an appropriate sealant.

In the preferred embodiment, the interference-type connectors 710, 800 that allow the joint edge members 202, 203 to self-release under the force of the concrete slabs 250, 350 shrinking during hardening are comprised of a malleable material such as nylon or other suitable material. The nylon components are suitably chosen according to the design tensile strength of the concrete such that the components yield under the shrinkage stress. Note that the design tensile strength is variable according to the conditions and application of the concrete slabs 250, 350. As the concrete slabs 250, 350 shrink, the studs 220, 225, which are embedded in the concrete slabs 250, 350 pull the joint edge members 202, 203 apart. Differential shrinkage and loading may also cause the joint edge members to move laterally with respect to each other. In the properly compatible design configuration, the nylon connectors yield under the shrinkage stress of the concrete to allow relative movement of the joint edge members.

While in the foregoing, there have been described various preferred embodiments of the present invention, it should be understood to those skilled in the art that various modifications and changes can be made without departing from the scope of the invention as recited in the claims. An effort has been made to prepare claims commensurate in scope with this description without any failure to claim any described embodiment and within the best abilities of the inventors to foresee any modifications or changes.

We claim:

1. For use in constructing hardened first poured and second and later poured substantially horizontal concrete slabs, each having an upright edge, on a slab support surface, said edge being at least at times in abutting contact with each other, wherein said slabs have interfacing protective elongated first and second upper joint edge members, wherein said concrete slabs are of a type that shrink during hardening of poured wet concrete that form said concrete slabs, said upright edge of said second slab having been physically formed and supported by the upright edge of said first slab, an upper joint edge construction assembly for constructing said first and second concrete slabs and interfacing upper joint edge members, said assembly comprising:

said first elongated rigid joint edge member for providing a first protective upper edge joint member along said upright edge of said first poured concrete slab after pouring and hardening of said first poured concrete slab, said second elongated rigid joint edge member for providing a second protective upper edge joint member along said upright edge of said second poured concrete slab after pouring and hardening of said second poured concrete slab, said first and second elongated joint edge members each having initially attached abutting sides and non-abutting sides, said initially abutting sides of each of said elongated rigid edge members being releasably attached together before pouring wet concrete to form said first poured and said second poured concrete slabs, interference type connectors for releasably attaching the elongated joint edge members to each other, said interference type connectors having release elements that release the joint edge members from each other, a first rigid stud member rigidly secured to said non-abutting side of said first elongated joint edge member, said first stud member projecting laterally away from said first joint edge member and being embedded in said first poured concrete slab during pouring of said wet concrete and after hardening of said first poured concrete slab, and a second rigid stud member rigidly secured to said non-abutting side of said second elongated joint edge member, said second stud member projecting laterally away from said second joint edge member and later being embedded in said second poured concrete slab during pouring of said wet concrete and after hardening of said second concrete slab, said embedded stud members having forcibly pulled each of said elongated abutting sides of said joint edge members away from each other caused by shrinkage of both of said first poured and said second and later poured concrete slab for causing said abutting sides of said joint edge members, having been initially attached by said interference type connectors, to release from each other for forming space between said initially abutting sides of said first and second joint edge members, said release elements allowing said joint edge members to release from each other as said stud members pull said joint edge members away from each other and from abutting interconnection by said interference type connectors including said release during shrinkage of said concrete slabs, said joint edge members thereby forming protective rigid edges along and between said first poured and second and later poured concrete slabs.

2. The assembly of claim 1 only initially having formwork secured directly to said first and second joint edge members.

3. The assembly of claim 2 including a dowel aligner member connected to said formwork, said dowel aligner member extending transversely into the region where said first concrete slab is to be poured, and a dowel being received by said dowel aligner member and extending into the region where said second concrete slab is to be poured thereby accurately positioning said dowel within both of the adjacent concrete slabs.

4. The assembly of claim 3 includes permanently attached formwork and thereby said dowel aligner is permanently attached to said assembly.

5. The assembly of claim 4 wherein a plurality of said dowel aligners and a plurality of said dowels are provided.

6. The assembly of claim 1 wherein a plurality of said first and second stud members are mounted along each of said elongated joint edge members.

7. The assembly of claim 6 wherein each of said first and second stud members includes means for adhering to the later poured concrete during hardening and shrinkage of said later poured wet concrete in said first and second concrete slabs.

8. The assembly of claim 7 wherein said adhering means includes an expanded head for adhering each of said stud members to said concrete during shrinkage of said concrete during hardening.

9. The assembly of claim 8 wherein multiple expanded heads are provided on said stud members.

10. The assembly of claim 1 wherein each of said elongated rigid joint edge members are constructed of steel.

11. The assembly of claim 10 wherein each of said first and second joint edge members are steel bars.

12. The assembly of claim 10 wherein each of said first and second joint edge members are steel angle members.

13. The assembly of claim 1 wherein said release elements are comprised of a nylon material.

* * * * *